United States Patent [19]

LaBorde

[11] 3,974,606

[45]*Aug. 17, 1976

[54] LINER FOR COVERING INTERSECTING SURFACES

[75] Inventor: Joseph N. LaBorde, Baton Rouge, La.

[73] Assignee: Ethyl Corporation, Richmond, Va.

[ * ] Notice: The portion of the term of this patent subsequent to Mar. 19, 1991, has been disclaimed.

[22] Filed: Dec. 23, 1974

[21] Appl. No.: 535,518

Related U.S. Application Data

[62] Division of Ser. No. 365,456, May 31, 1973, Pat. No. 3,902,292, which is a division of Ser. No. 191,871, Oct. 22, 1971, Pat. No. 3,797,185.

[52] U.S. Cl. ..... 52/288; 52/213; 52/716

[51] Int. Cl.[2] ..... E04F 19/02

[58] Field of Search ..... 52/213, 214, 215, 287, 52/288, 290, 716, 717, 254

[56] References Cited

UNITED STATES PATENTS

| | | | |
|---|---|---|---|
| 1,838,129 | 12/1931 | Baum | 52/215 |
| 2,902,727 | 9/1959 | Samolis | 52/212 |
| 3,160,280 | 12/1964 | Burch | 52/241 X |
| 3,310,920 | 3/1967 | Bell et al. | 52/309 |
| 3,354,586 | 11/1967 | Den Besten | 52/213 X |
| 3,559,356 | 2/1971 | Koral | 52/288 X |
| 3,568,386 | 3/1971 | Gossen | 52/288 |
| 3,609,928 | 10/1971 | Mock | 52/214 X |
| 3,717,968 | 2/1973 | Olsen et al. | 52/288 |

FOREIGN PATENTS OR APPLICATIONS

| | | | |
|---|---|---|---|
| 1,659,632 | 4/1970 | Germany | 52/214 |
| 1,946,996 | 3/1971 | Germany | 52/214 |
| 2,012,841 | 10/1971 | Germany | 52/214 |
| 2,124,781 | 12/1972 | Germany | 52/214 |
| 2,128,441 | 12/1972 | Germany | 52/214 |
| 1,997,869 | 12/1963 | Netherlands | 52/214 |

*Primary Examiner*—Ernest R. Purser
*Assistant Examiner*—Leslie A. Braun
*Attorney, Agent, or Firm*—Donald L. Johnson; John F. Sieberth; Paul H. Leonard

[57] ABSTRACT

A liner for covering one of two intersecting surfaces. The liner includes a face for attaching to a wall, a return connected to the face, and a spring connected to the return or to the face.

11 Claims, 13 Drawing Figures

LINER FOR COVERING INTERSECTING SURFACES

CROSS-REFERENCE TO RELATED APPLICATIONS

This is a division of application Ser. No. 365,456, filed on May 31, 1973, now U.S. Pat. No. 3,902,292, which in turn is a division of application Ser. No. 191,871, filed on Oct. 22, 1971, now U.S. Pat. No. 3,797,185.

BACKGROUND OF THE INVENTION

It is well known in the construction art that extruded plastic and aluminum trim can be used on door molding, window frames, sills, and the like. Such extruded trim can be used in trimming out any penetration of a wall or any intersecting surfaces within a house or other structure. Most known trim requires a considerable amount of labor and time to install. The trim must be nailed to the intersecting surfaces of window frames and door frames and then must be nailed to the wall surrounding the frame. Nail holes must be puttied, and the trim precisely fitted to conform to the structured frame. If the window sill is not completely plumb or square, a much greater amount of time and labor is required to trim the frame.

It is an object of the present invention to provide a method and an article of manufacture for quickly and economically covering or lining a door frame or window frame, or any two intersecting surfaces in general.

It is another object of the present invention to provide a method and article of manufacture for quickly and economically lining a door frame or window frame which is not plumb or square.

In accordance with the present invention there is provided a liner for covering one of two intersecting surfaces including a face means having an exposed side and a hidden side, a return means having an exposed side and a hidden side connected to the face means, and a spring means connected to the hidden face of the return means or the face means.

Figure 1:
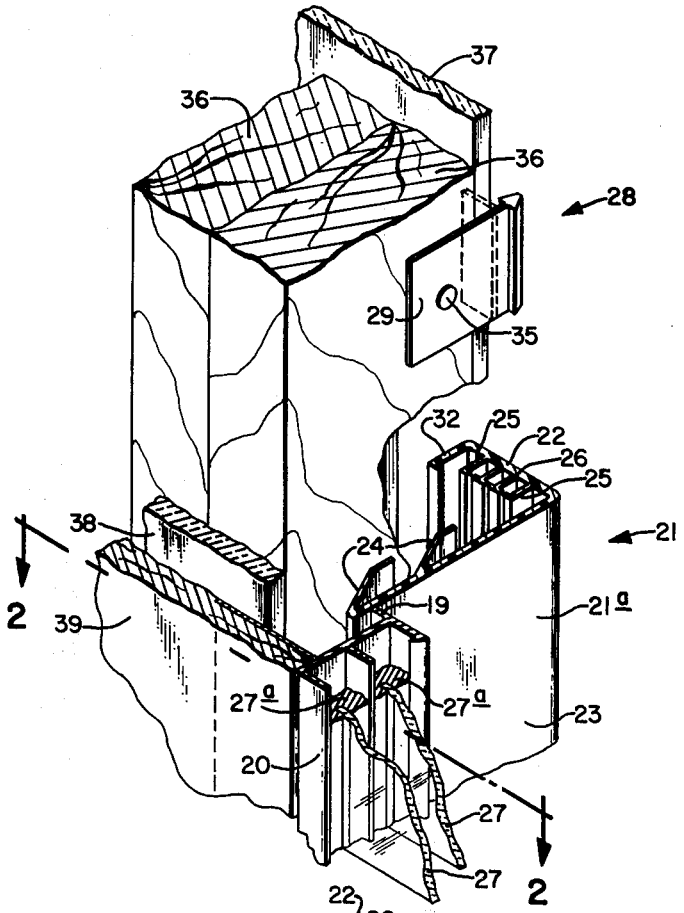
Figure 2:
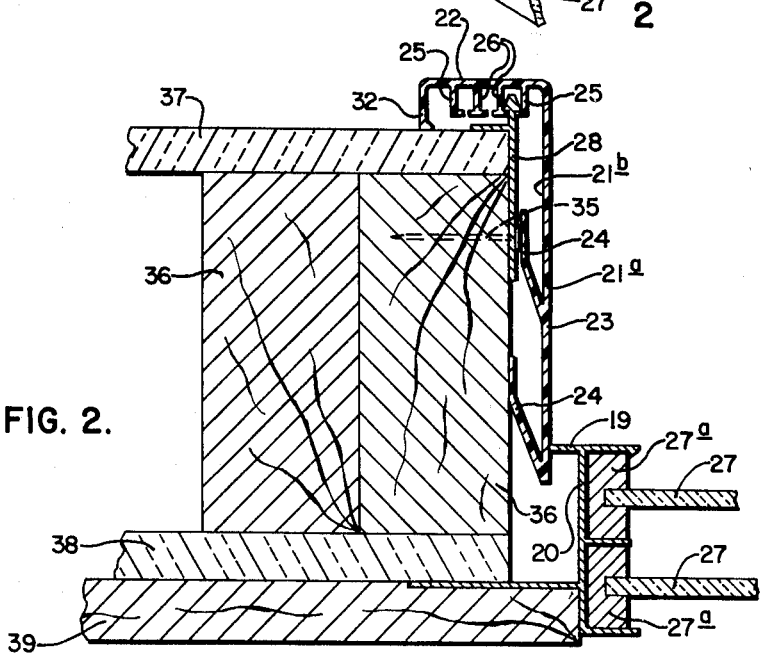
Figure 2A:
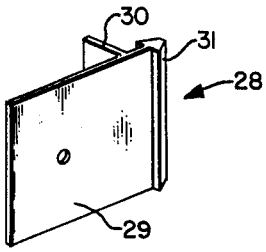
Figure 3:
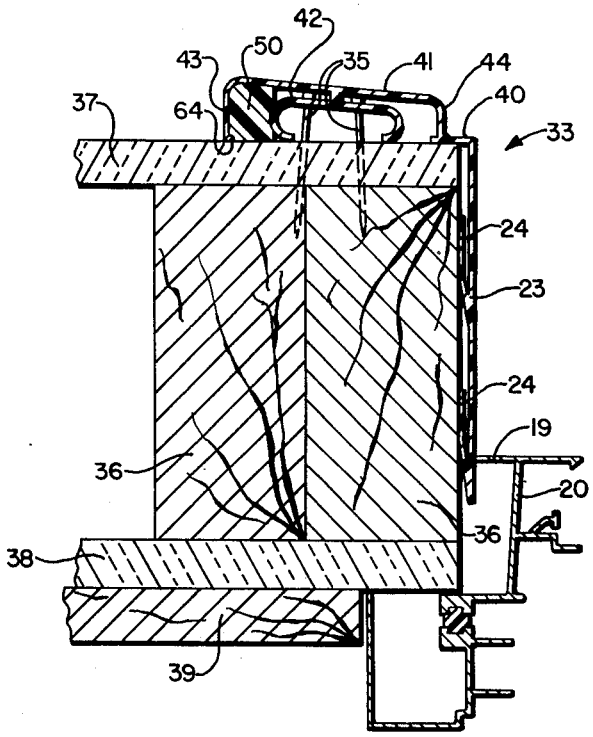
Figure 3A:
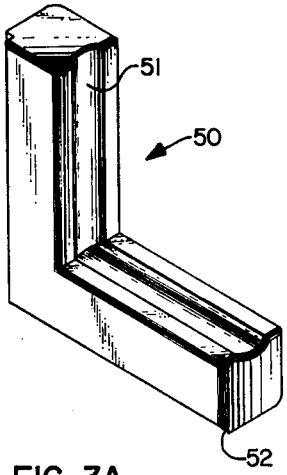
Figure 4:
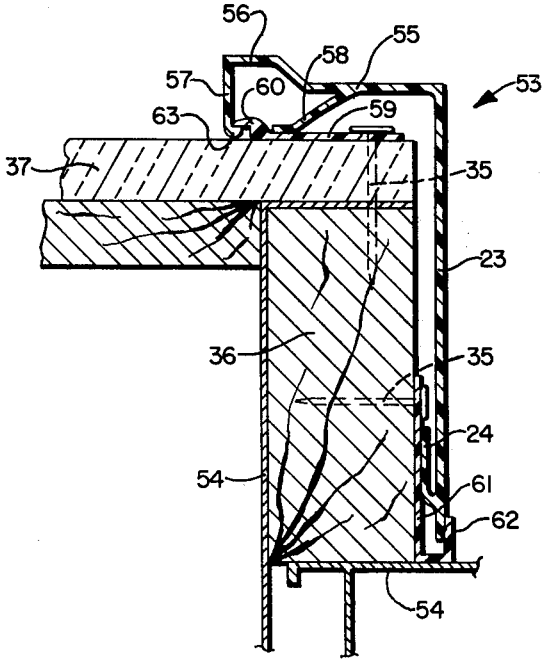
Figure 5:
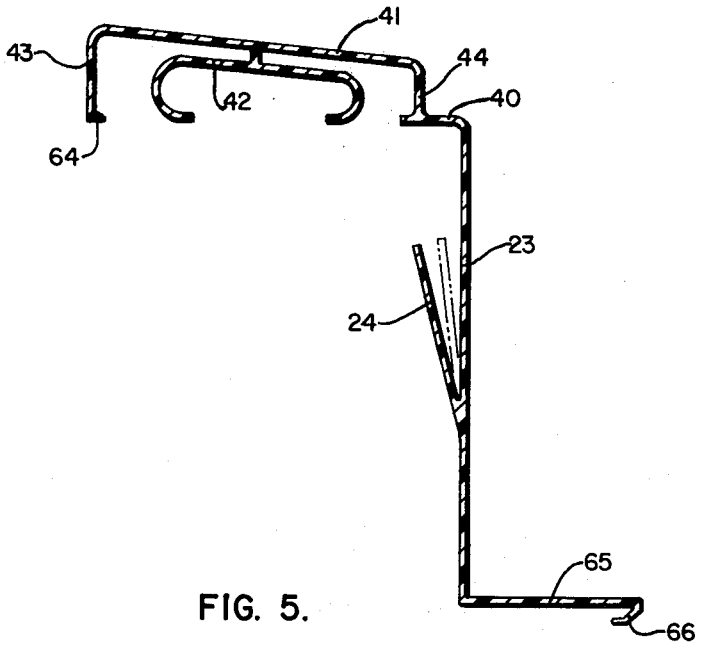
Figure 6:
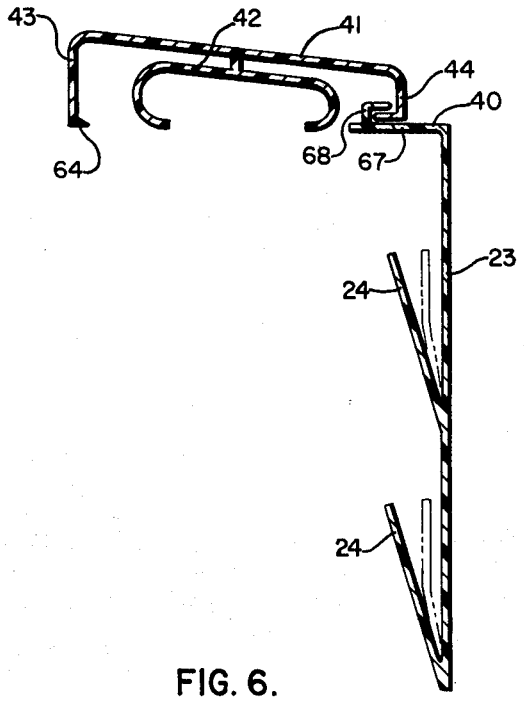
Figure 7:
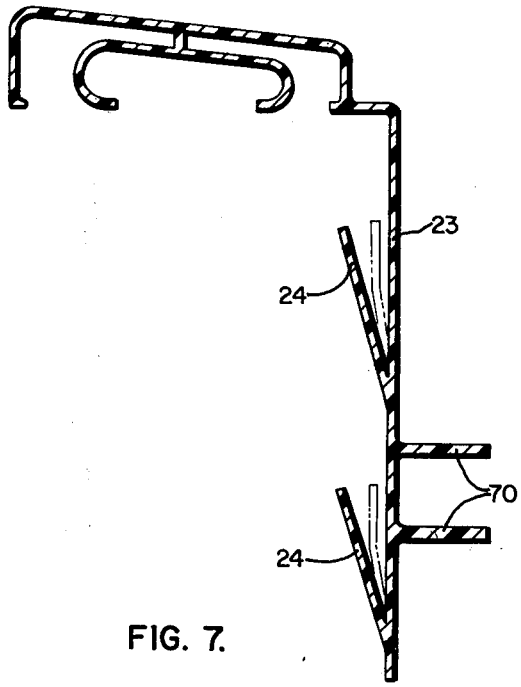
Figure 8:
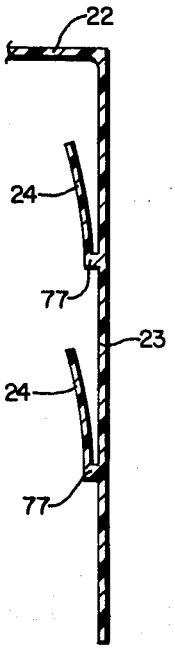
Figure 9:
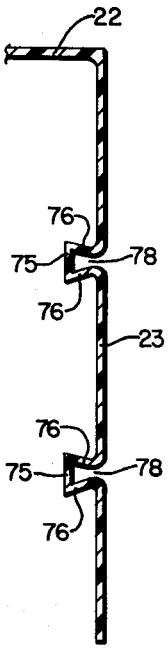
Figure 10:
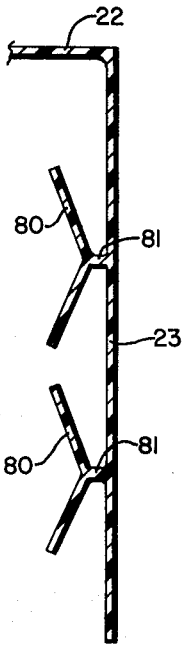
Figure 11:
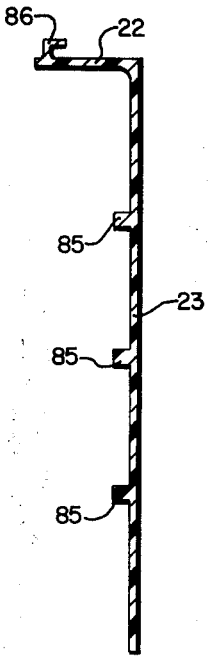

The invention will be more readily understood by reference to the drawings in which:

FIG. 1 - is an elevational perspective view, partially broken, of the liner of the present invention attached to a window frame;

FIG. 2 - is a cross-sectional view of the window frame of FIG. 1 taken along line 2—2;

FIG. 2A - is a perspective view of an aligning clip;

FIG. 3 - is a cross-sectional view of a window frame to which is attached another embodiment of the present invention;

FIG. 3A - is a perspective view of a reinforcing block used in the embodiment shown in FIG. 3;

FIG. 4 - is a cross-sectional view of a window frame employing an embodiment of the present invention;

FIG. 5 - is a cross-sectional view of an embodiment of the present invention;

FIG. 6 - is a cross-sectional view of an embodiment of the present invention;

FIG. 7 - is a cross-sectional view of an embodiment of the present invention;

FIG. 8 - is a cross-sectional view of an embodiment of the present invention;

FIG. 9 - is a cross-sectional view of an embodiment of the present invention, FIG. 10 - is a cross-sectional view of an embodiment of the present invention; and FIG. 11 - is a cross-sectional view of an embodiment of the present invention.

Referring now to the drawings, the liner designated generally by the numeral 21 of the present invention can be seen in FIGS. 1 and 2 attached to a wood frame 36 to form a trim or liner for the window frame 20. As can be seen in the drawings, liner 21 is made from one integrally formed piece of material such as metal, plastic, and the like, although plastic is preferred. Liner 21 has a hidden inside surface **21*b* and an exposed or outside surface 21*a*. The surface 21*b* inside of liner 21 shown in FIGS. 1 and 2 has attached thereto spring members 24—24 and a plurality of channel wall members 25. The inside surface 21*b*** faces the wall and window frame and can't be seen after the liner is installed.

Liner 21 includes a liner return portion 23 connected to liner face 22. Liner face 22 forms an approximate 90° angle with the liner return 23. However, the liner face 22 may be constructed so that it forms any angle with the liner return 23 greater than 0° but less than 180°.

The return portion 23 of the liner 21 has the two spaced apart springs 24—24 attached to its inside surface. One or more springs may be used, but two springs are preferred. The springs 24—24 serve to force the return portion 23 of the lines 21 snugly against window frame edge 19 which is a part of the window frame 20.

The inside surface of liner face 22 is provided with a plurality of spaced apart channel walls 25 which have protuberances 26 on their ends. Located at one end of liner face 22 is liner lip 32 which fits snugly against wall covering 37. In FIG. 2A is shown an aligning clip, designated generally by the numeral 28, which is used to fasten liner 21 to the wood frame 36. Aligning clip 28 includes a clip return portion 29 which fits flush against the end of wall covering 37 and wood frame 36. The outer end of the clip return is provided with a clip lock 31, which is generally trapezoidal in shape. The clip lock 31 is received between two adjacent channel wall members 25—25. The protuberances 26—26 on the bottom of the channel walls 25—25 engage the clip lock 31 and holds the liner 21 snugly against the wall covering 37. Aligning clip 28 may also have a transversely extending clip face 30 which spaces the clip lock 31 the proper distance from wall covering 37. Aligning clip 28 is fastened in position by a nail 35, or a screw if desired, as shown in FIGS. 1 and 2.

As seen in FIGS. 1 and 2, sheathing 38 is provided on the outside wall of the house or structure and outside siding 39, which may be wood, plastic or metal, is affixed to the sheathing. In FIGS. 1 and 2 is shown two window glasses 27—27 mounted in window frame 20 by means of mounting strips **27*a*—27*a*.**

FIG. 3 shows another embodiment of the present invention. Outside siding 39 and sheathing 38, wall covering 37 and wood frame 36 are the same elements described in the embodiment shown in FIGS. 1 and 2. Window frame 20 has a slightly different configuration which is immaterial to the explanation of the invention. The return position 23 and springs 24—24 of the liner 33 shown in FIG. 3 are the same as the corresponding elements shown in FIGS. 1 and 2. Liner 33 has a subface 40 which is joined at a right angle on one edge to liner return 23. One edge of liner face 41 is connected at a right angle adjacent the other edge of subface 40. Liner main face 41 has connected to its inside surface a generally C-shaped liner brace 42 which provides a means for attaching the liner 33 to the wall covering 37. Although a C-shaped brace 42 is preferred, the brace may also be of any suitable shape known in the art.

Between one end of liner brace 42 and the liner lip 43 a corner block 50, shown in FIGS. 3 and 3A, is inserted. Corner block 50 has a groove 51 therein which receives the rounded portion of liner brace 42 and a notch 52 which receives lip 64 provided at the terminal portion of liner lip 43. Four precut mitered pieces of liner 33 may be locked together with corner block 50 at each corner to form a completed window liner structure and after placing in the window opening nails or screws 35 are inserted to hold the liner in position.

A further embodiment of the present invention is shown in FIG. 4. The liner 53 of the embodiment shown in FIG. 4 has a return 23 similar to the other liners and has one spring 24 mounted on the inside surface of the liner return 23. The liner has a large subface 55 intersecting the return portion 23 at an angle of about 90°. The subface inside surface has a lower spring 58 projecting downwardly therefrom. Liner 53 has a raised small subface 56 connected to the larger subface 55. Subsurface 56 has a lower lip portion 57 with its lower end in abutment with wall covering 37.

A locking strip or clip 59 is used to hold liner 53 in place. The locking strip 59 abuts wall covering 37 adjacent the end thereof and is held in place by a nail, screw, or other fastener 35. One end of the locking strip 59 is provided with raised locking strip lip 60 which engages the inturned lip 63 provided on the lower end of lip portion 57 to hold the forward part of the liner 53 against the facing 37. To hold the rear part of return 23 in position, a trim strip 61 is used. The strip 61 is fastened to wood frame 36 by means of a nail or screw 35. Trim strip 61 has a U-shaped lip 62 which receives the rear edge of the return 23. The rear edge of the return maintains firm contact with the lip 62 by means of the pressure applied by spring 24. Trim strip 61 is fastened snugly against window frame 54, thereby enabling the liner to be used even where there is no overhanging edge provided on the window. The use of an overhanging edge 19 is shown in FIG. 3 under which the edge of the return 23 is placed.

FIG. 5 shows another embodiment of the present invention having a liner surface 40, liner main face 41, liner brace 42, outer liner lip 43, and inner liner lip 44 identical to the embodiment shown and explained in FIG. 3. However, the embodiment shown in FIG. 5 has only one spring 24, and at the end of return 23 has a liner face lip 65 forming an approximate right angle with the return 23. A hook 66 is provided at the end of the lip 65 for hooking onto a window frame (not shown) having an edge parallel to liner face lip 65. The angle between liner face lip 65 and the return 23 may be greater than 0° but less than 180°.

In FIG. 6 of the present invention another embodiment is shown in which liner main face 41, liner brace 42, outer liner lip 43, and inner liner lip 44 are the same as in FIG. 3. At the end of inner liner lip 44 is main face hook 67. Connected to liner subface 40 is an L-shaped liner subface hook 68 which engages main face hook 67 to lock the liner main face section firmly to the contact return section. Return 23 also employs two springs 24—24 extending from its rear surface.

The liner shown in FIG. 7 is identical to that shown in FIG. 3 with the exception that the liner has spaced apart storm sash tracks 70—70 connected to the outer face of return 23. The storm sash tracks 70—70 permit a storm sash to be inserted therein. By storm sash is meant a secondary sash located inside the outside sash for holding a second, inside window.

FIGS. 8–11 depict various types of springs that are suitable for use in the liner structures of the present invention. In FIG. 8, springs 24—24 are connected to the rear face of the return 23 by means of short legs 77—77 which intersect spring 24 and return 23 at substantially right angles.

FIG. 9 discloses springs of a generally trapezoidal configuration. Each spring has a base 75 connected by two opposed sides 76—76 to the return 23. The spring is constructed so that return 23 has two slot-like openings 78—78 therein.

FIG. 10 shows another spring design in which the springs 80—80 are generally Y-shaped and are connected at the base of the Y to the return 23.

FIG. 11 discloses a spring design which includes a series of rectangular shaped protuberances 85—85 connected to the inner face of the return 23. Liner face 22 has an integrally formed hook 86 at one end thereof for engaging other separately formed trim sections as seen in FIG. 6.

What is claimed is:

1. A liner for covering a portion of each of two intersecting surfaces comprising:

a. face means for abutting one of said surfaces, projection means on one end of said face means and extending therefrom for contacting said one of said surfaces and extending generally parallel to a return means connected to said face means;

b. said return means connected to said face means, said return means being so constructed as to cover at least a part of the other of said surfaces; spring means connected to the inner surface of said return means for contacting said other of said surfaces, and storm sash track means connected to the exposed side of said return means.

2. A liner for covering a portion of each of two intersecting surfaces comprising:

a. face means for abutting one of said surfaces, face means spring means connected to the inner surface of said face means, projection means on one end of said face means and extending therefrom for contacting said one of said surfaces and extending generally parallel to a return means connected to said face means; and b. said return means connected to said face means, said return means being so constructed as to cover at least a part of the other of said surfaces, and return means spring means connected to the inner surface of said return means for contacting said other of said surfaces.

3. The liner of claim 2 wherein said liner has an inside surface which is substantially free of contact with the portion of said intersecting surfaces to be covered by said liner.

4. The liner of claim 2 wherein said face means has a means thereon for engaging a fastening means attached to said one of said surfaces.

5. The liner of claim 2 including holding means for retaining said face means and said return means in position adjacent said intersecting surfaces.

6. The liner of claim 2 wherein said return means comprises a plurality of said spring means.

7. The liner of claim 2 wherein said return means has a means thereon for engaging a fastening means attached to said other of said surfaces.

8. The liner of claim 2 wherein said return means has a liner face lip connected thereto and extending therefrom.

9. The liner of claim 2 wherein said spring means comprises a flat strip integrally connected at one end to the inside surface of said return means.

10. The liner of claim 2, wherein said face means has a second projection means on the other end thereof and extending therefrom at substantially a right angle thereto for contacting said one of said surfaces and said return means has a member on one end thereof extending inwardly at substantially a right angle therefrom and connected to said second projection means for contacting said one of said surfaces.

11. A liner for covering a portion of each of two intersecting surfaces comprising:

a. face means for abutting one of said surfaces, projection means on one end of said face means and extending therefrom at substantially a right angle thereto for contacting said one of said surfaces and extending generally parallel to a return means connected to said face means; and, b. said return means connected to said face means at substantially a right angle thereto, said return means being so constructed as to cover at least a part of the other of said surfaces; and wherein said face means and said return means are two separate components and said face means has means on the other end thereof for lockedly engaging said return means and said return means has means on one end thereof for lockedly engaging said face means; and, c. spring means connected to the inner surface of said return means for contacting said other of said surfaces.

* * * * *